US011814884B2

(12) United States Patent
Sak

(10) Patent No.: US 11,814,884 B2
(45) Date of Patent: Nov. 14, 2023

(54) BARRIER LOCKING SYSTEM AND METHOD

(71) Applicant: Robert F. Sak, Fort Pierce, FL (US)

(72) Inventor: Robert F. Sak, Fort Pierce, FL (US)

( * ) Notice: Subject to any disclaimer, the term of this patent is extended or adjusted under 35 U.S.C. 154(b) by 0 days.

(21) Appl. No.: 17/119,232

(22) Filed: Dec. 11, 2020

(65) Prior Publication Data

US 2021/0180375 A1 Jun. 17, 2021

Related U.S. Application Data

(60) Provisional application No. 62/946,538, filed on Dec. 11, 2019.

(51) Int. Cl.

| | |
|---|---|
| ***E05C 19/00*** | (2006.01) |
| ***E05C 1/02*** | (2006.01) |
| *E05B 63/00* | (2006.01) |

(52) U.S. Cl.
CPC ..... *E05C 19/003* (2013.01); *E05C 1/02* (2013.01); *E05Y 2900/132* (2013.01)

(58) Field of Classification Search
CPC ... Y10T 292/23; Y10T 292/28; Y10T 292/34; Y10T 292/37; Y10T 292/54; Y10T 292/65; Y10T 292/67; E05C 19/003; Y10S 292/15; Y10S 292/37; E05B 17/2011; E05B 17/2015; E05B 55/00; E05B 2047/0084; E05B 2047/0086; E05B 2047/0088; E05B 65/1006; E05B 65/1013
See application file for complete search history.

(56) References Cited

U.S. PATENT DOCUMENTS 343,298 A * 6/1886 Conn ..... E05C 17/446 292/193
385,599 A * 7/1888 Dunlap ..... E05B 37/20 292/180
414,495 A * 11/1889 Conn ..... E05C 17/446 292/193
426,765 A * 4/1890 Brunhoff ..... E05B 85/22 292/DIG. 31
618,818 A * 2/1899 Adams ..... E05B 63/20 292/181

(Continued)

FOREIGN PATENT DOCUMENTS

CA 2283545 C 10/2003
CN 101351608 A 1/2009

(Continued)

OTHER PUBLICATIONS

Mar. 4, 2021 (WO) International Search Report and Written Opinion—App. PCT/US2020/064223, 7 pages.

*Primary Examiner* — Carlos Lugo
(74) *Attorney, Agent, or Firm* — Darrell G. Mottley

(57) ABSTRACT

A manually activated locking device is provided to inhibit and restrict an entry/exit door from opening either outward or inward or both, as installed. In one aspect, the device that can be set from inside the room to be protected from threats or intrusion. In one aspect, the locking device is designed to be tamper-proof from outside the room yet allows access by authorized individuals thereby creating a secure but accessible safe zone for individuals or property inside the zone. In one aspect, the activated locking device may be mechanical system which may prevent hacking on the locking device.

16 Claims, 18 Drawing Sheets

(56) References Cited

U.S. PATENT DOCUMENTS 624,941 A * 5/1899 Jensen ..... E05B 53/003 292/171
670,854 A * 3/1901 Deibel ..... E05B 37/20 292/180
684,018 A * 10/1901 Wellman ..... E05C 19/06 292/DIG. 37
963,527 A * 7/1910 Dessauer ..... E05C 19/004 70/94
1,005,849 A * 10/1911 Lange ..... E05C 17/446 292/61
1,111,485 A * 9/1914 Melander ..... E05B 85/22 292/167
1,185,422 A * 5/1916 Mammelli ..... E05C 3/124 292/254
1,871,142 A * 8/1932 Bianchi ..... E05C 17/446 292/DIG. 28
1,977,430 A * 10/1934 Dalton ..... E05C 19/182 292/296
2,140,066 A * 12/1938 White ..... E05C 19/182 292/296
3,111,340 A * 11/1963 Spencer ..... E05C 17/443 292/229
3,664,164 A * 5/1972 Zaidener ..... B60R 25/0221 70/202
4,213,315 A * 7/1980 Lewis ..... E05C 19/004 70/94
4,334,705 A 6/1982 Rumph
4,617,810 A * 10/1986 Fish ..... E05B 65/0894 70/14
5,395,143 A * 3/1995 Chesterton ..... E05C 17/48 292/57
5,791,173 A 8/1998 Montes
5,983,680 A * 11/1999 Del Nin ..... E05C 9/10 70/93
5,984,387 A * 11/1999 Zeller ..... E05C 19/182 292/296
6,520,551 B1 2/2003 Crnkovich
6,755,450 B1 * 6/2004 Chen ..... E05C 19/182 292/289
7,021,683 B2 * 4/2006 Nissen ..... E05C 19/004 292/339
7,437,900 B1 * 10/2008 Slone ..... E05C 19/004 70/135
7,637,130 B2 * 12/2009 Carr ..... E05B 47/00 292/259 R
7,770,420 B2 * 8/2010 Carr ..... E05C 19/003 292/259 R
7,788,954 B2 * 9/2010 Schumm ..... E05C 17/48 292/41
9,163,441 B1 10/2015 Taylor, III
9,567,782 B2 2/2017 Raatikainen
2006/0279093 A1 12/2006 Tang
2017/0191306 A1 7/2017 Falesch et al.
2021/0017796 A1 * 1/2021 Bergman ..... E05C 19/003

FOREIGN PATENT DOCUMENTS

CN 202148749 U 2/2012
CN 108571243 A 9/2018
FR 2136249 A5 12/1972
GB 2263303 A * 7/1993 ..... E05C 17/446
JP 4669765 B2 4/2011
TW M459270 U 8/2013
WO 2009052154 A1 4/2009
WO 2019030605 A1 2/2019

* cited by examiner

BARRIER LOCKING SYSTEM AND METHOD

CROSS-REFERENCE TO RELATED APPLICATIONS

The present application claims priority to U.S. App. No. 62/946,538 filed Dec. 11, 2019, the contents of which are incorporated herein by reference in their entirety.

FIELD OF THE DISCLOSURE

The present disclosure generally relates to a barrier locking system and method.

BACKGROUND

There has been a significant increase in school shootings between the 1980s and 2000s. Government reports on school shootings by the US Secret Service, FBI, and Department of Education provide an explanation of factors contributing to shootings. During an active situation, it may be difficult to maintain a safe space while awaiting the arrival of emergency response personnel. Deterrents currently on the market may require different components to be set in place when needed and requires storage space until used. While some products may restrict a hostile person or persons from entering a room, others fail in that task. Many products fail to take into account the potential need for Police or EMS personnel to gain entry into a room during an emergency. Once engaged or set in place, several of these units have no way to be unlocked by Police, EMS or rescue units making a critical situation untenable. The items currently available do not address or consider the necessity for quick and immediate access to mitigate and potentially neutralize an immediate threat. Further, many current products do not meet the requirements detailed in the National Fire Protection Association Life Safety Code for door locks. Current products failing to address the above noted access and egress requirements put all potential targets, at high risk. These include Schools, Office Buildings, Stores, Government Buildings etc. due to the inability of police, security forces and rescue personnel to enter and neutralize the situation or by hampering egress from the room in case of fire or other emergency.

SUMMARY

In light of the foregoing background, the following presents a simplified summary of the present disclosure in order to provide a basic understanding of some aspects of the disclosure. This summary is not an extensive overview of the disclosure. It is not intended to identify key or critical elements of the disclosure or to delineate the scope of the disclosure. The following summary merely presents some concepts of the disclosure in a simplified form as a prelude to the more detailed description provided below.

Various aspect of the present disclosure relates to a barrier locking system and method. An aspect of the disclosure pertains to a barrier apparatus for a door. The apparatus may have a slidable lock rod having a plurality of grooves disposed longitudinally. A pivot lever may be provided having a tip engageable with the grooves of the lock rod and a cam member may be engageable with the pivot lever. In one aspect, the cam member may be rotatable to pivot the lever downwardly to disengage the tip from the grooves of the lock rod.

In another aspect, the apparatus may include a button having a distal tip being engagable with the pivot lever; the button being linear movable to pivot the lever downwardly to disengage the tip from the grooves. In another aspect, the button further include a coil spring configured to urge the button away from the pivot lever.

In another aspect, a wire member being connected to pivot lever; the wire member being linear movable to pivot the lever downwardly to disengage the tip from the grooves. In another aspect, a bushing may be included on the lock rod and a coil spring disposed around the lock rod, the coil spring may be configured to urge the lock rod vertically by abutting engagement of the bushing. In another aspect, the lock rod may be constructed of a plastic or metal (aluminum, steel) material. In another aspect, a control box has a control portion housing the pivot lever and a rod region for retaining the lock rod.

An aspect of the disclosure pertains to a barrier apparatus for a door including a slidable lock rod having a plurality of grooves disposed longitudinally; a pivot lever having a tip engageable with the grooves; and a teardrop shaped member engageable with the pivot lever; the member being rotatable to pivot the lever downwardly to disengage the tip from the grooves.

In one aspect, a manually activated locking device is provided to inhibit and restrict an entry/exit door from opening either outward or inward or both, as installed. In one aspect, the device that can be set from inside the room to be protected from threats or intrusion. In one aspect, the locking device is designed to be tamper-proof from outside the room yet allows access by authorized individuals thereby creating a secure but accessible safe zone for individuals or property inside the zone. In one aspect, the activated locking device may be mechanical system which may prevent electronic hacking of the locking device.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

DETAILED DESCRIPTION

Figure 1:
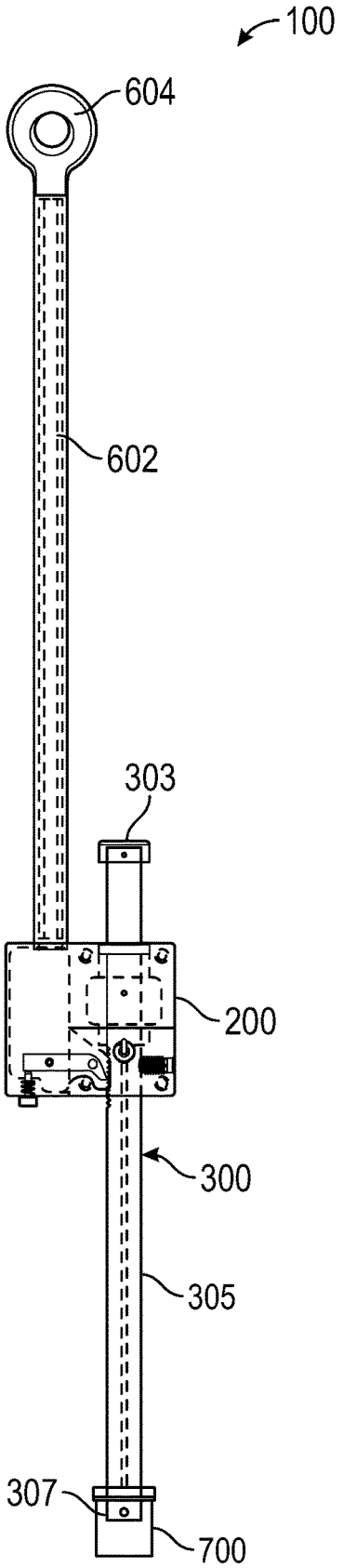
FIG. 1 illustrates a schematic diagram of a front elevation of the barrier locking system in which certain aspects of the present disclosure may be implemented.
Figure 2:
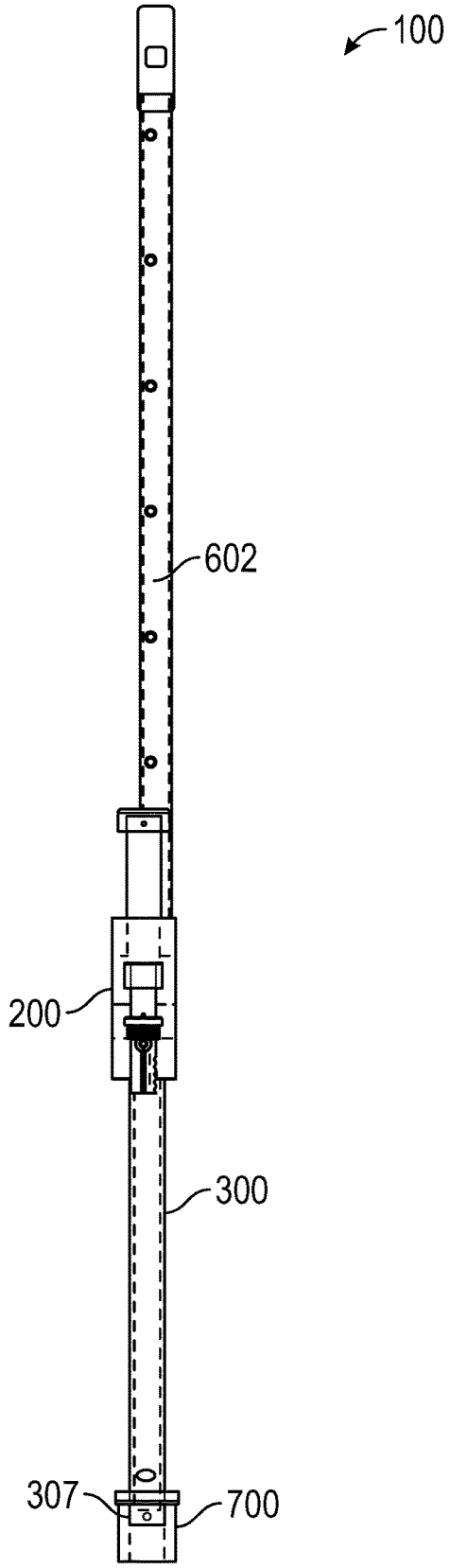
FIG. 2 illustrates a schematic diagram of a side elevation of the barrier locking system in which certain aspects of the present disclosure may be implemented.
Figure 3:
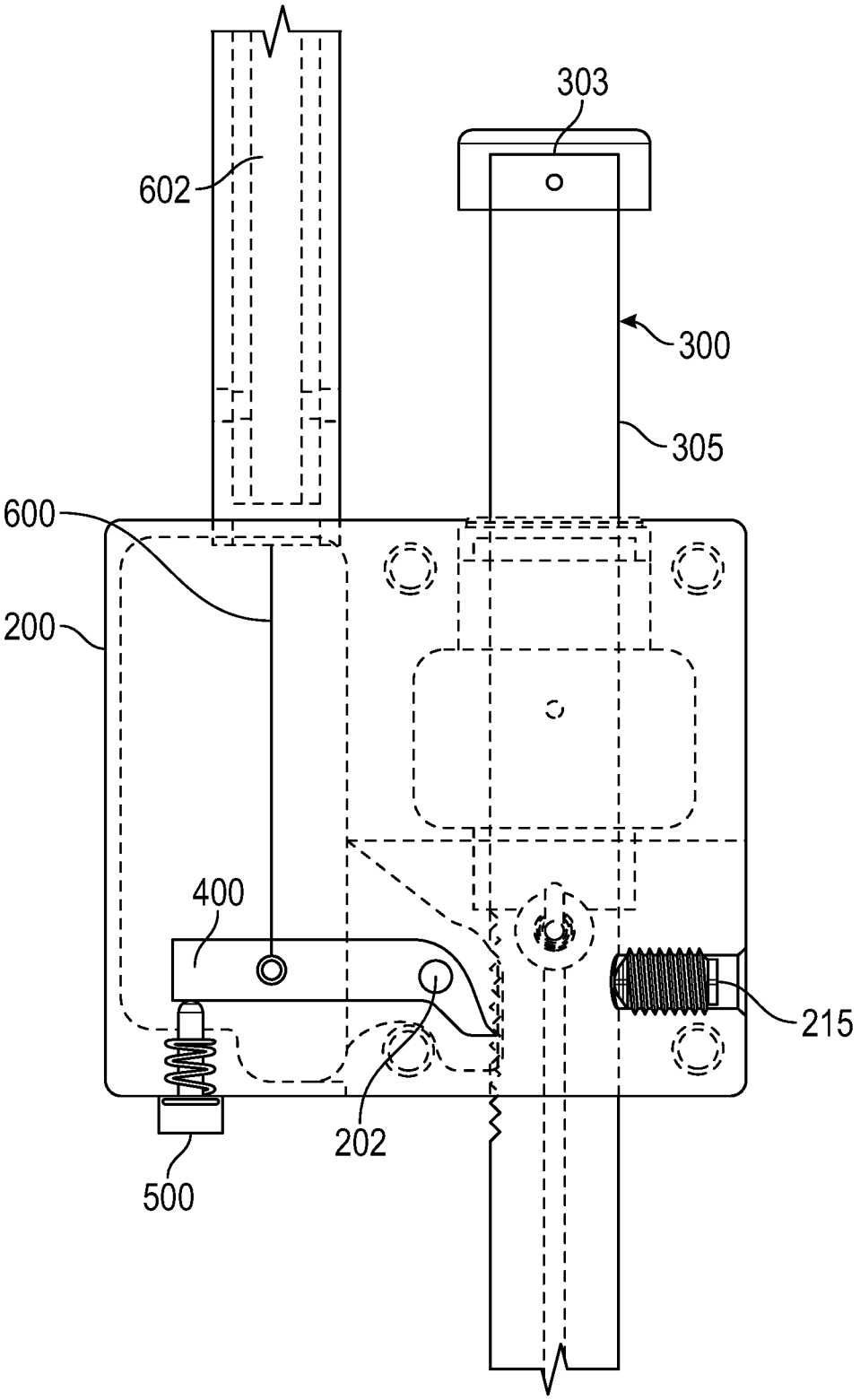
FIG. 3 illustrates an enlarged view of the control assembly in accordance with one or more constructions and implementations of the present disclosure.

In the following description of the various embodiments, reference is made to the accompanying drawings, which form a part hereof, and in which is shown by way of illustration, various embodiments in which the disclosure may be practiced. It is to be understood that other embodiments may be utilized and structural and functional modifications may be made.

As illustrated in the FIGS. 1-15, a barrier locking system 100 provides a locking and releasable apparatus for a barrier that defeats unauthorized entry attempts by those who would disrupt or have intent to do harm to individuals or property protected therein. The barrier locking system 100 can be implemented to a classroom, office, meeting room or conference room such that office or rooms can be rendered a safe room easily accessible by first responders or other law enforcement or rescue authorities and other individuals.

One or more constructions, the barrier locking system 100 may include a control box 200, a vertically movable door rod 300, a pivot lever 400 engageable with the barrier or dock look rod 300, a release button 500, a release wire member 600, an optional floor insert member 700, and optional key 900.

Figure 6:
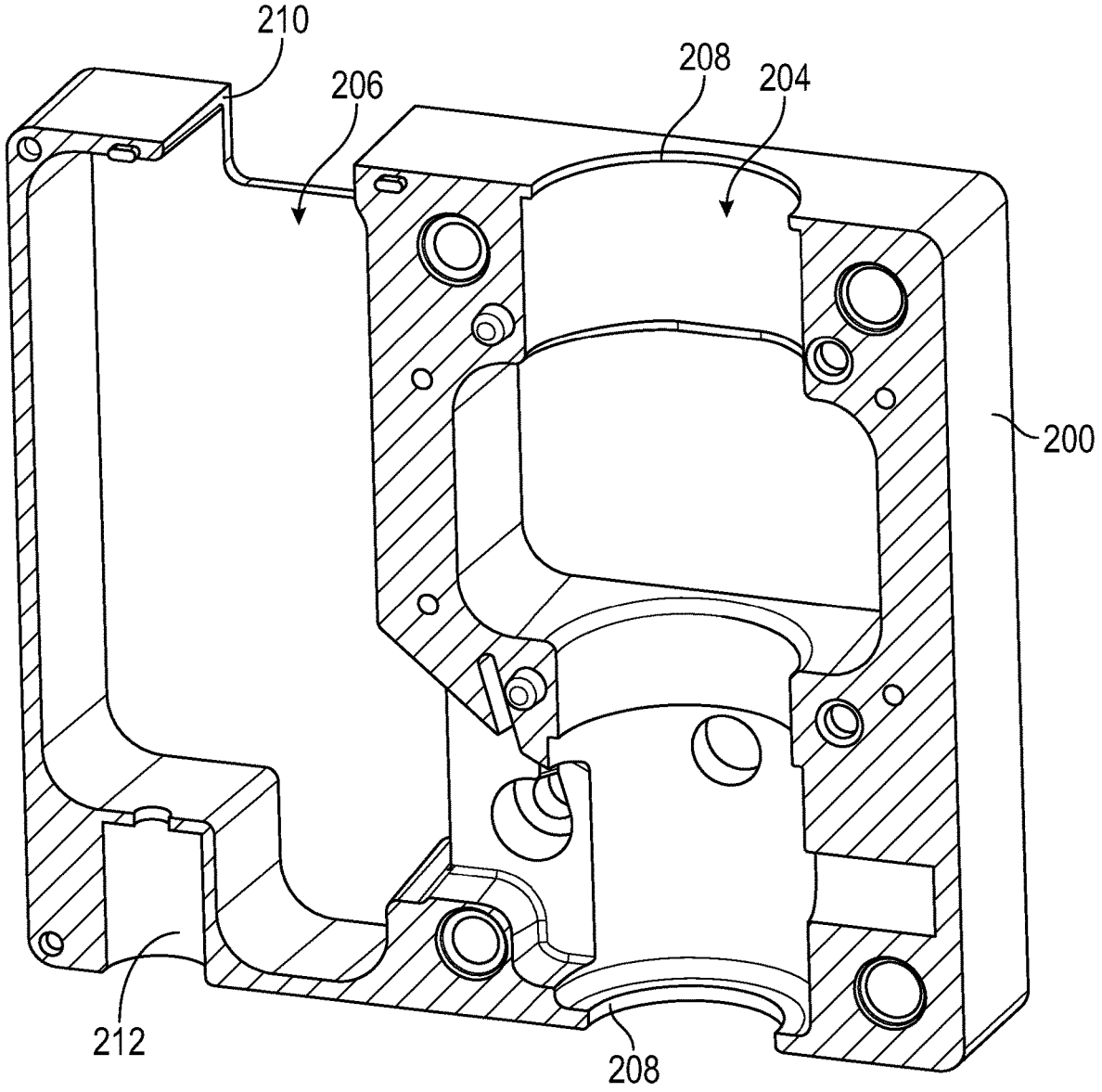
FIG. 6 illustrates an enlarged view of the internal structure of a control box in accordance with one or more constructions and implementations of the present disclosure.

Referring to FIG. 6, the control box 200 includes several functional regions a rod region 204 for retaining and operation of the door rod 300 and a control region 206 for locking and unlocking the door rod 300. The rod region 204 may have a circular openings 208 at the top and bottom of the control box 200 of a diameter slightly larger than the diameter of the rod 300 to enable to rod 300 for freely move vertically within box 200. The control region 206 includes a top opening 210 sized to receive an end of the wire cover 602. The wire cover 602 generally has a U-cross-Sectional shape. The bottom of box 200 includes a cylindrical cavity 212 configured to receive the release button 500 and a button coil spring 508. The control box 200 can be of a mold configuration, metal casted or machined.

Referring to FIGS. 1-5 and 10-11, the door rod 300 is provided in a spring mounted arrangement with a coil spring 302 configured resiliently urged the rod 300 upward in vertical movement in the control box 200. In one construction shown in FIGS. 1-5, the rod 300 may have a top cap 303 mounted to a cylindrical body 305 and a distal end 307 which engages and enters into a cavity of the floor insert member 700. The rod body 305 includes a plurality of indents or a vertical set of grooves 309. The rod body 305 has an indented groove construction vertically into the surface which may be tuned to the length and depth of vertical movement up-and-down and the position at which the door rod 300 stays in place. In some constructions, the set of grooves 309 can be 10, 12, 15-20 depending of the increment of vertical movement for locking engagement with the lever 400. The grooves 309 are disposed longitudinally on the rod body 305. The length of each groove 309 is disposed perpendicular to the longitudinal axis of the rod 300. The tip 307 may be an indent portion 313 configure to receive a set screw 215. The rod 300 may be constructed of suitable metal material, such as steel and higher strength aluminum or other material. In another construction shown in FIGS. 10-11, the door rod 300 rod body 305 may be of ridge arrangement. The rod body 305 can be of an extruded or injected molded higher strength plastic or metal (aluminum, steel) material. And the tip 307 may be constructed from aluminum or another metal material.

Figure 4:
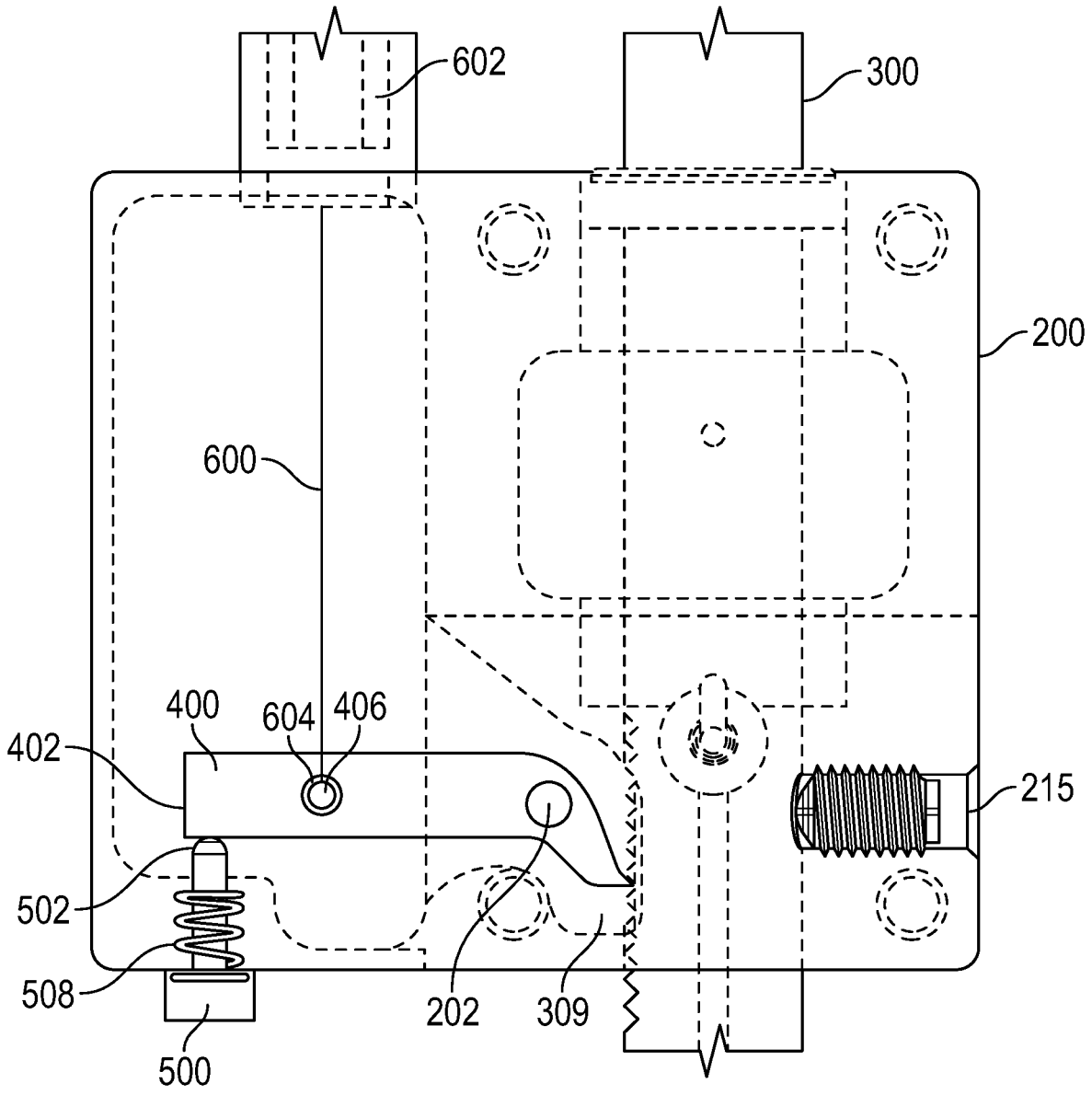
FIG. 4 illustrates an enlarged view FIG. 3 in accordance with one or more constructions and implementations of the present disclosure.
Figure 5:
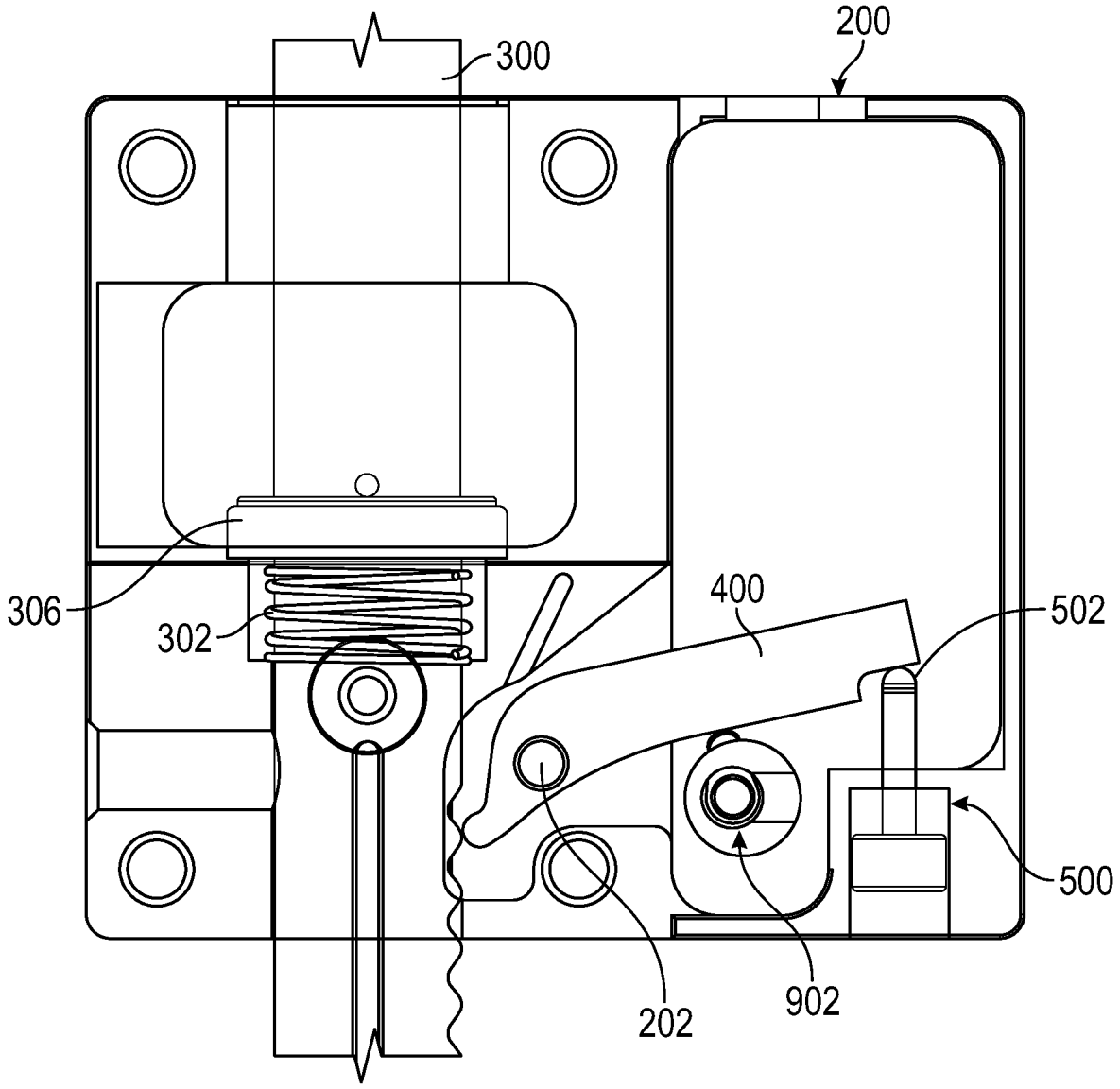
FIG. 5 illustrates an enlarged view of the control assembly showing a releasing position in accordance with one or more constructions and implementations of the present disclosure.
Figure 7:
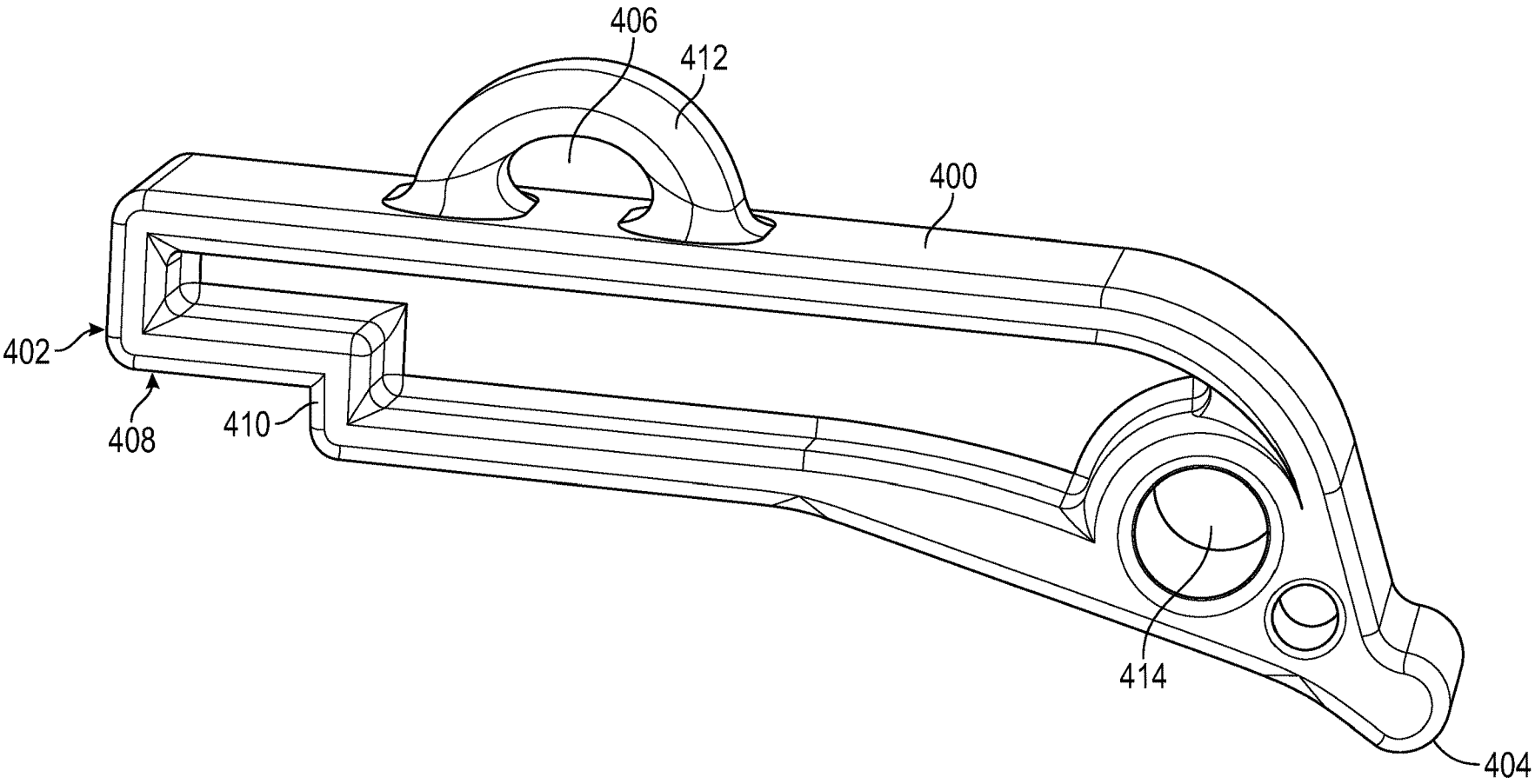
FIG. 7 illustrates a pivot lever in accordance with one or more constructions and implementations of the present disclosure.
Figure 8:
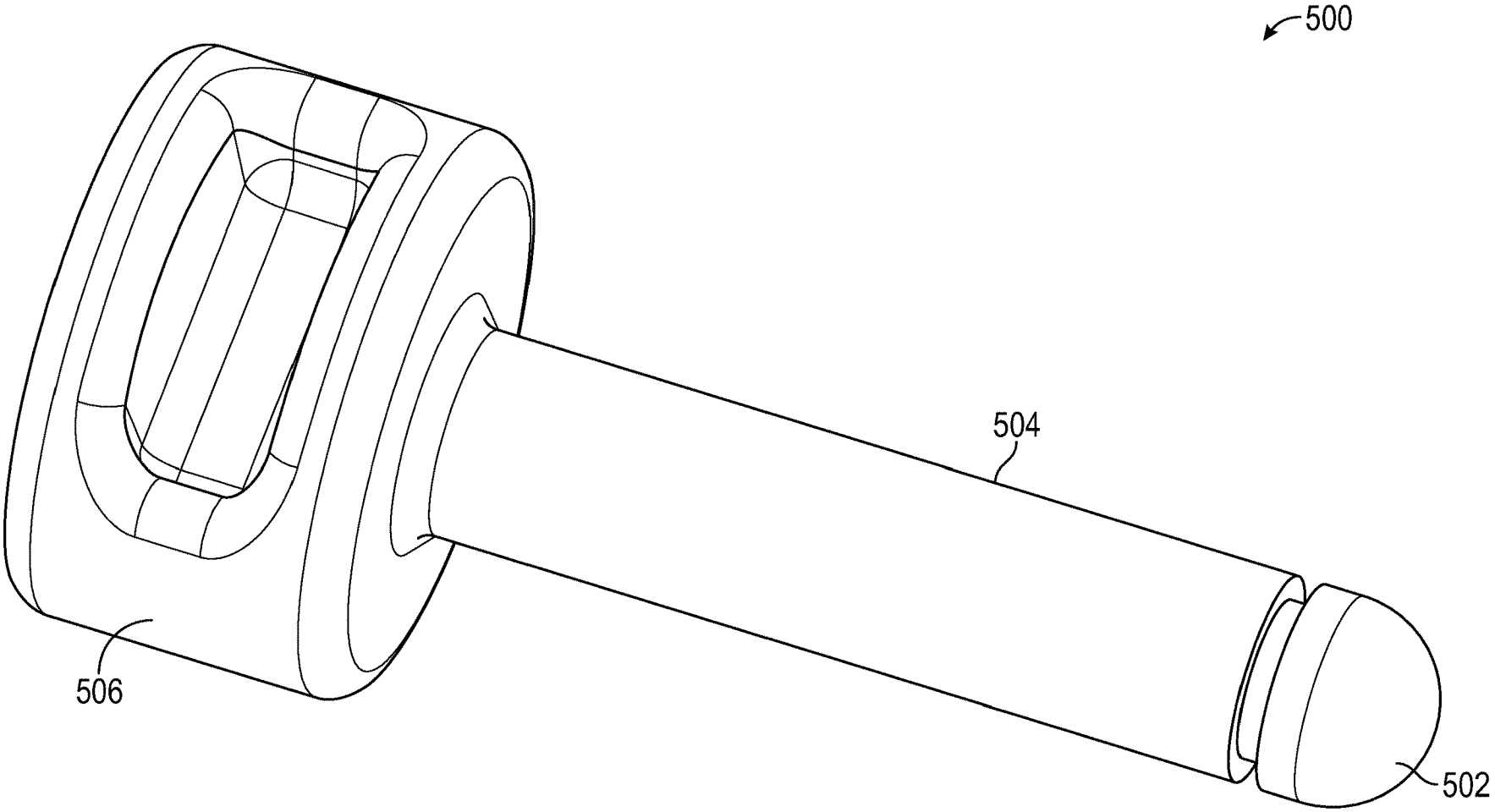
FIG. 8 illustrates a release button in accordance with one or more constructions and implementations of the present disclosure.

The pivot lever 400 is pivotally mounted to pivot pin 202 in the control box 200 to engage the grooves 309 in the rod body 305. The lever 400 has distal end 402 and opposing tip 404. Distal end 402 is configured to abut and engage a distal tip 502 of the release button 500. The tip 404 of lever 400 is configured to matingly engage one of move of grooves 309 as best shown in FIG. 4 and disengage from the groove 309 based on mechanically action as shown in FIG. 5. Level 400 includes a hole 406 for retaining an end of the release wire member 600. FIG. 7 shows one construction of level 400, including the distal end 402 is provided in the form of an indent portion 408 and a sidewall 410 in which the distal tip 502 of the release button 500 can provide an enhanced abutting configuration. Still referring to FIG. 7, the hole 406 is provided via handle-like protrusion 412 extending from a top surface of the level 400. As been seen in FIG. 7, a cylindrical cavity 414 is shown in which the pin 202 engages and extends therethrough. The pivot lever 200 can be of a molded configuration, metal casted or machined.

Release button 500 includes a distal tip 502 connected to a shaft body 504 with on connected to a pad body 506. The distal tip 502 can be provided in the shape of hemisphere construction. The shaft body 504 may be in the form of an elongated cylinder. The pad body 506 is provided in the form of a short cylinder of greater diameter of the shaft body 504. The pad body 506 may be sized for a tip of the finger of user so that the user can reliably engage the button 500 upward to unlock the door rod 300. The release button 200 can be of a molded configuration, metal casted or machined.

Figure 9:
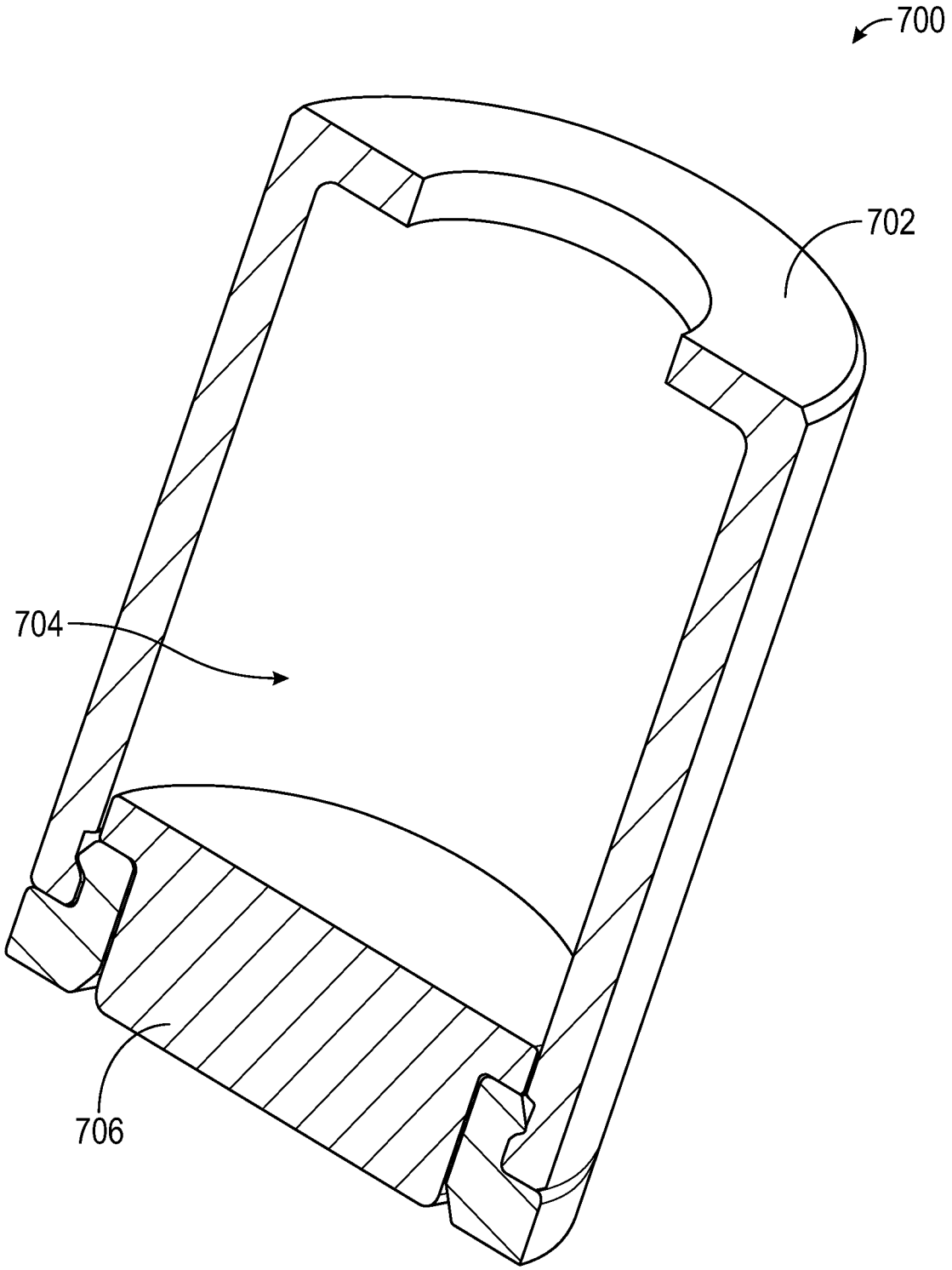
FIG. 9 illustrates a longitudinal sectional view of floor insert device in accordance with one or more constructions and implementations of the present disclosure.
Figure 10:
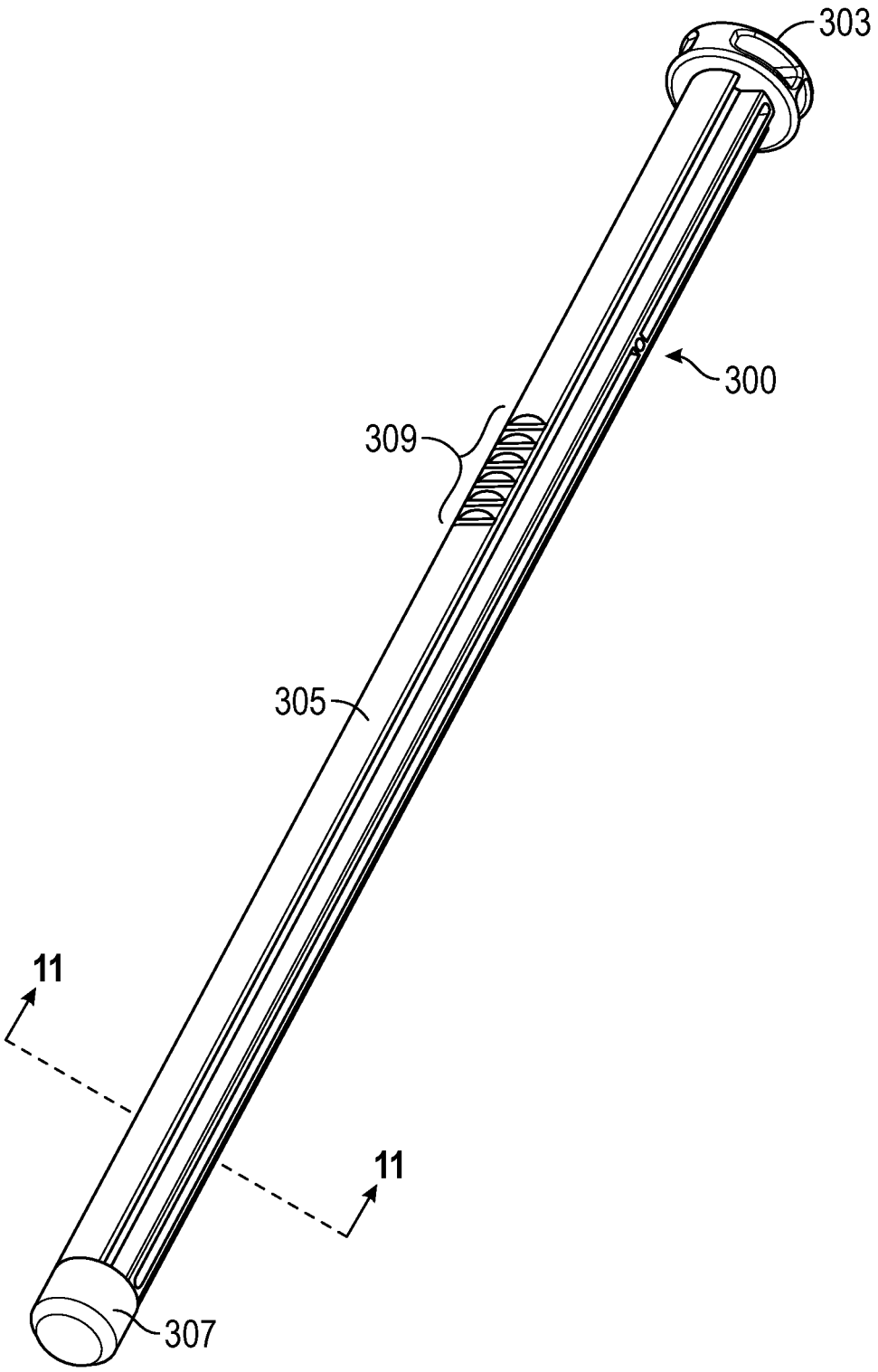
FIG. 10 illustrates a door lock rod construction in accordance with one or more constructions and implementations of the present disclosure.
Figure 11:
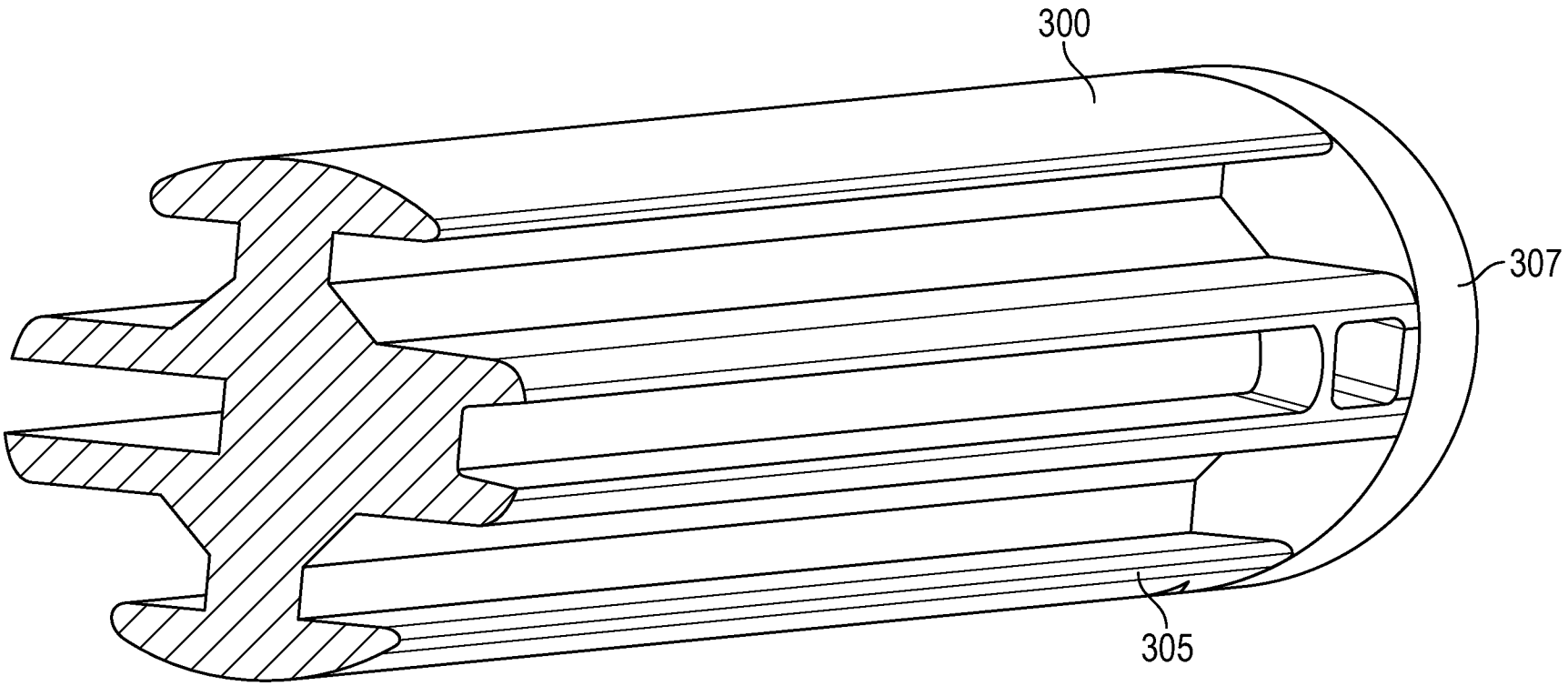
FIG. 11 illustrates a cross-section of the door lock rod taken along line 11-11 in FIG. 10 in accordance with one or more constructions and implementations of the present disclosure.
Figure 12:
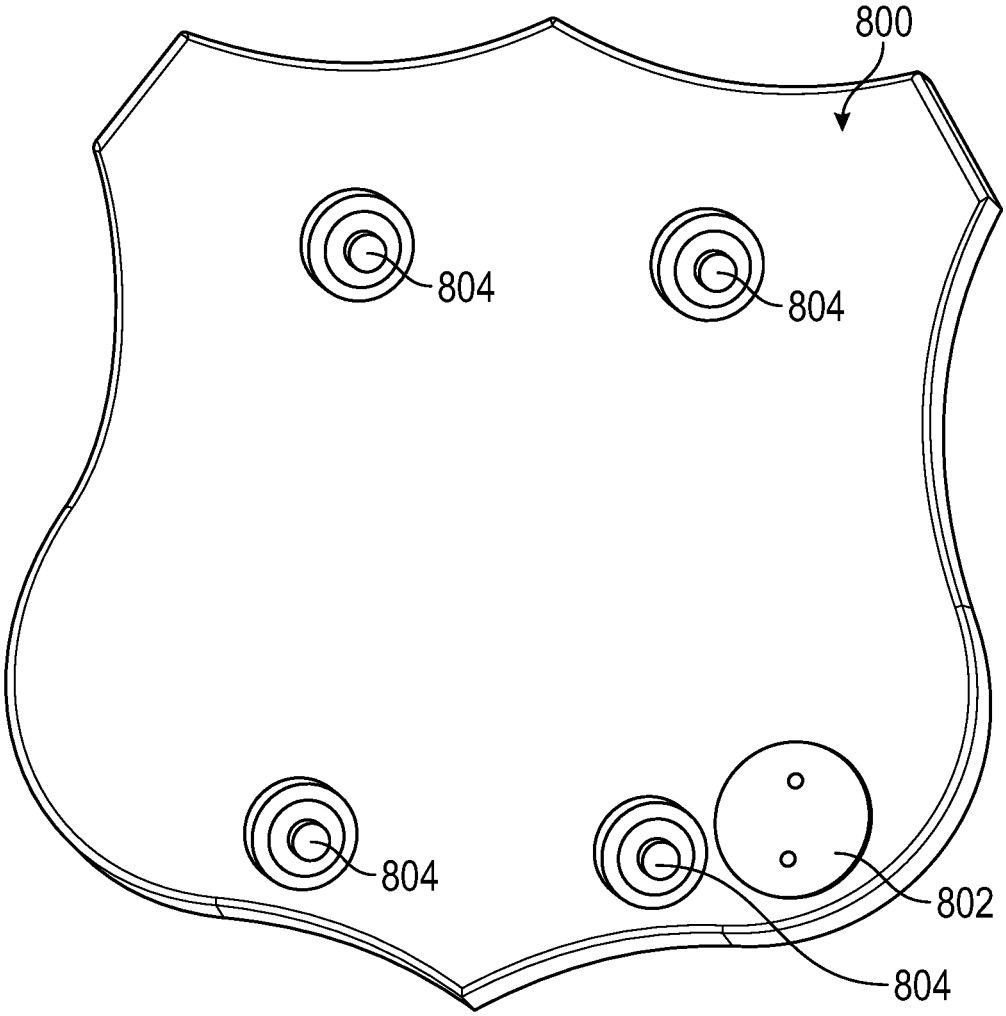
FIG. 12 illustrates a device plate accordance with one or more constructions and implementations of the present disclosure.

Referring to FIG. 9, the floor insert 700 may have hollow cylindrical construction to received the door rod 300. The top plate 702 may have a circular cutout. The internal cavity 704 has a depth sufficient to provide engage of the door rod 300 end. The bottom of the insert 700 may include a base 706. In one construction, the cavity 704 of the floor insert 700 may include a coil spring configured to compress when the door rod 300 enters the cavity 406. The coil spring diameter may be smaller than the door rod 300 diameter. In operation, the coil spring can resiliently urge the door rod 300 upward when the spring decompresses. The floor insert 700 can be of a molded configuration, metal casted or machined.

Figure 14:
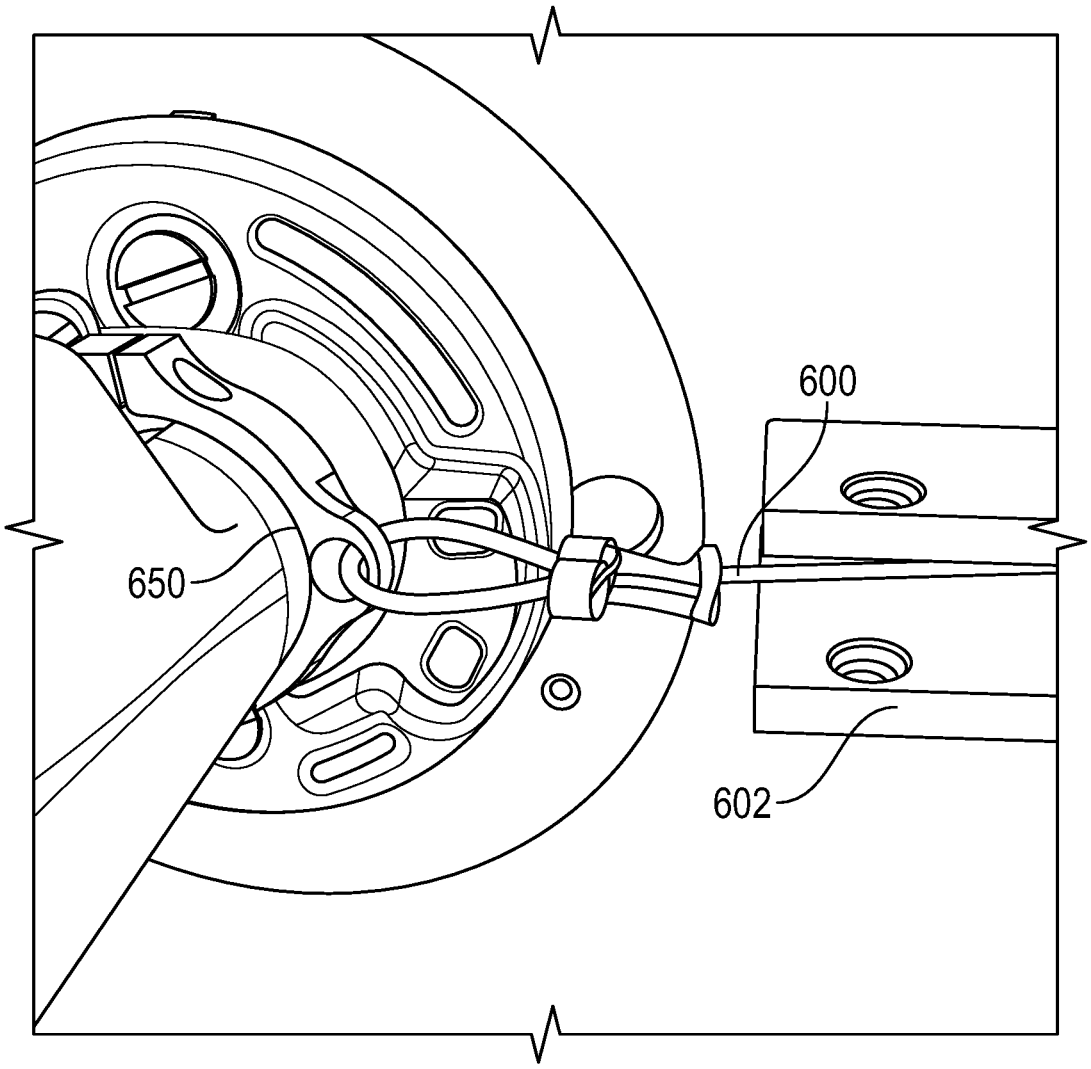
FIG. 14 illustrates a wire member door arrangement accordance with one or more constructions and implementations of the present disclosure.
Figure 15:
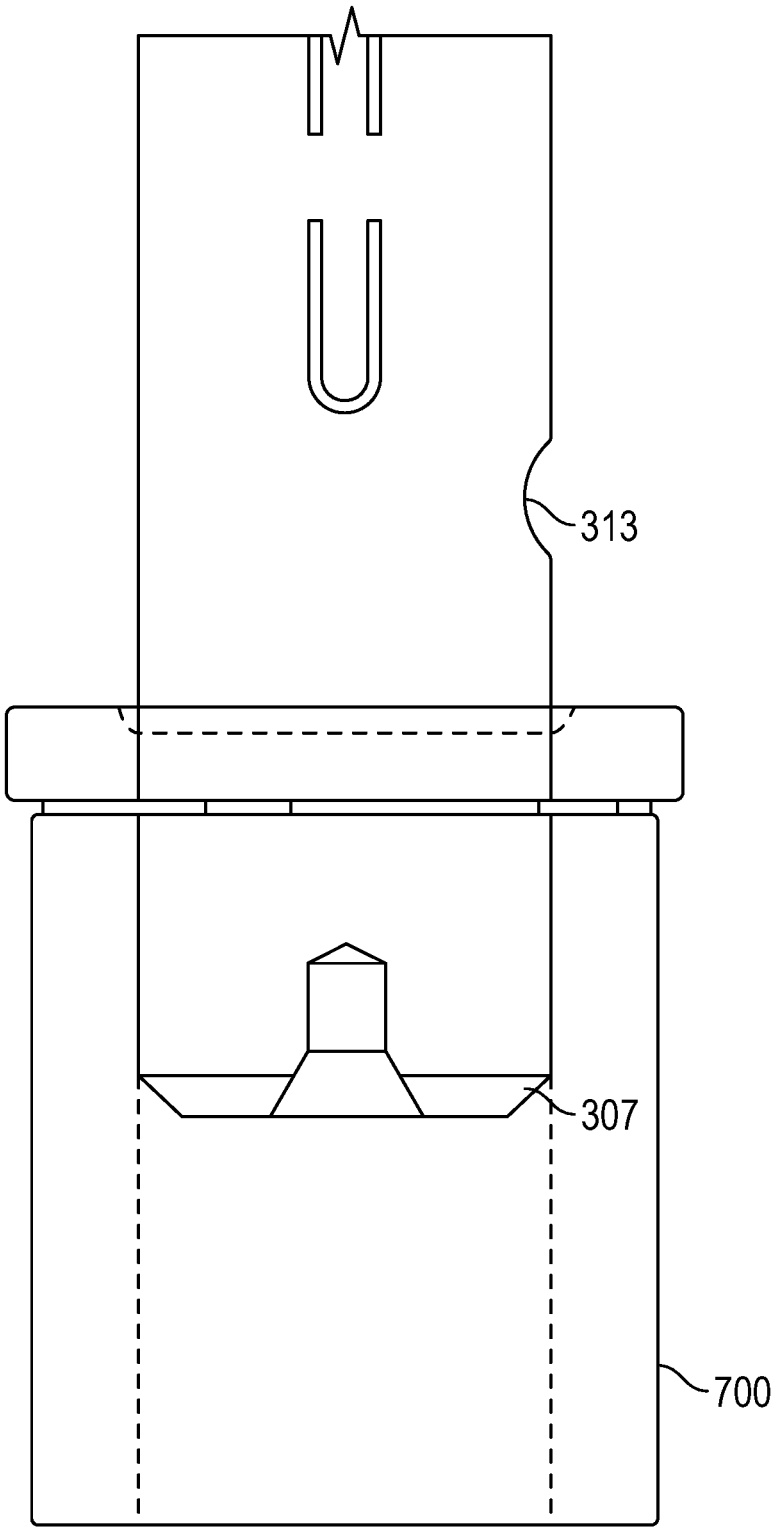
FIG. 15 illustrates an enlarged view of lower door rod and insert arrangement accordance with one or more constructions and implementations of the present disclosure.

Release wire 600 is housed in a wire cover 602 with an elongated pathway. In one construction, the wire cover 602 has a U-cross-Sectional shape providing that pathway. Nevertheless, the cross-sectional shape could a channel with 90 angles. The wire cover 602 acts as a fascia protective panel to prevent the wire 600 from being tampered or damaged. The cover 602 is securely mounted to the door surface and a top loop portion 604 encircles the round portion of the door knob or handle. The control far end 604 of the release wire 600 is connected to the pivot lever 400 in particular to the hole 406. The handle end of the wire 600 is connected to spindle of knob 650 as shown in FIG. 14. The wire member 600 can be any number of forms such as cylindrical, flexible strand or rod of metal. Nevertheless, wire member 600 can be of high strength plastic/composite material, stranded, non-woven or woven elongated fibers.

Shield Plate 800 can be any geometrical planar shape. It provides for mounting of the control box 200 though the door by way of mounting recesses 804. Port 802 with a cover is provided to protect the port pathway to engage the pivot lever 400. The access port/hole 802 allows Emergency Management Service (EMS) or Police Department (PD) to use key 900 so as to disengage the lock bar 300. The plate 800 can be of a mold configuration, metal casted or machined.

Figure 13:
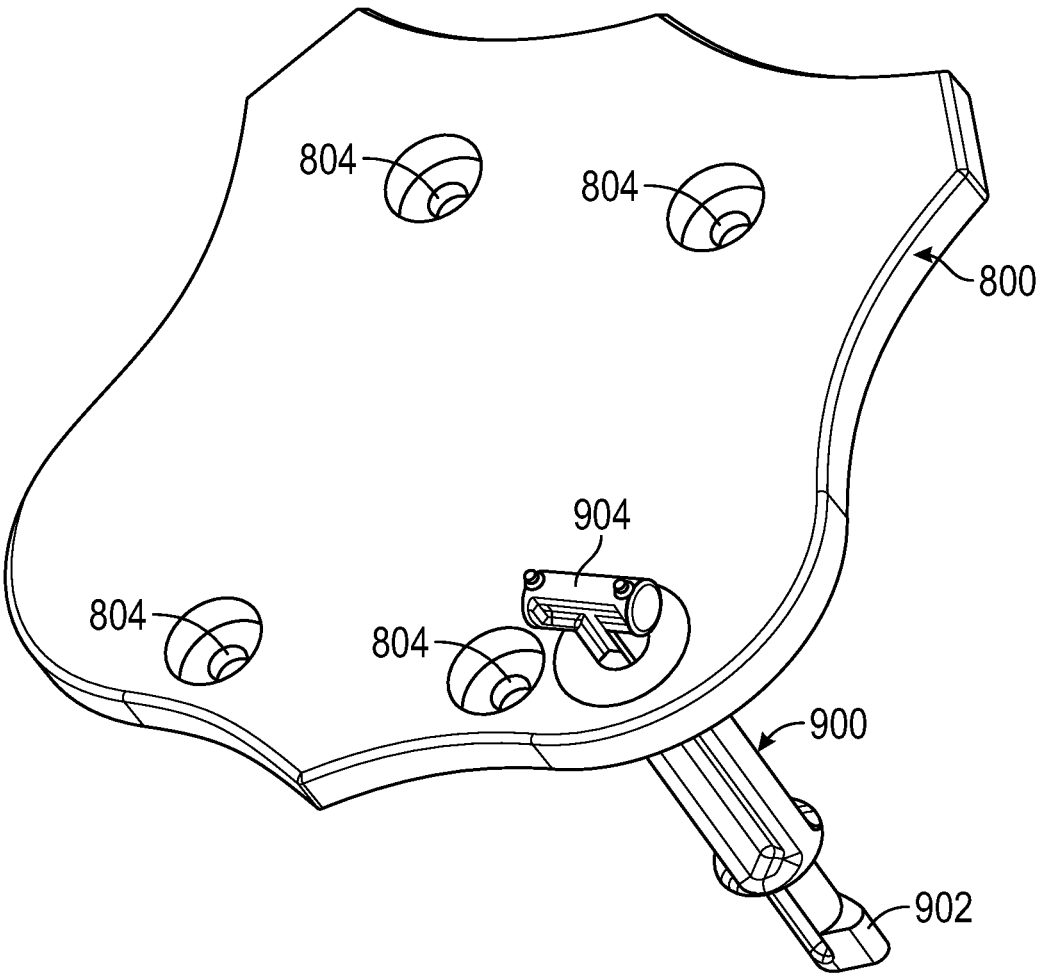
FIG. 13 illustrates a device plate and cam key accordance with one or more constructions and implementations of the present disclosure.

Referring to FIG. 13, the key 900 is provided to be extended through the mounting plate 800. In one construction, the key 900 includes a distal cam end 902 and a T-shaped handle 904. The cam end 902 includes a teardrop curved construction for abutting and engaging the pivot level 400 to cause movement of lever 400. The cam end 902 may be a projection on the rotating key, designed to make sliding contact with the pivot lever 400 while rotating and to impart upward motion to the lever 400. The key 900 can be of a mold configuration, metal casted or machined.

The door locks using one vertical movement push down on the door lock rod 300 until it seats in the floor insert 700. Unlocking is accomplished using any one of three methods. Method 1—by rotating the door handle in either direction disengages the lock rod from the floor insert. In this method, the wire 600 is wound around the knob/handle such that the wire 600 is pulled upward when the knob is turned from the inside of the room. As the wire 600 moves upward, the tip 404 of the pivot lever 400 rotates downwardly on pin 202 such that the tip 404 becomes disengaged from the grooves 309 of the door lock rod 300. The coil spring 302 can then resiliently urge the rod 300 upward by pushing on the rod bushing 306.

Method 2—Pushing the release button 500 on the bottom of the box disengages the lock rod 300 from the floor insert 700. As the release button 500 in pushed upward, the distal tip 502 pushes upward on the end 402 of the lever 400. In one motion, the tip 404 of the pivot lever 400 rotates downwardly on pin 202 such that the tip 404 becomes disengaged from the grooves 309 of the door lock rod 300. The coil spring 302 can then resiliently urge the rod 300 upward by pushing on the rod bushing 306.

Method 3—Use two protrusions on the key to remove the security cover that hides the key access port. Then, insert and turn the EMS key 900 from the outside (hallway side) to disengage the lock rod 300 from the floor insert 700. The port 802 has an access port through the door to accommodate the key 900 accessible from an exterior side. As the key 900 is rotated, the cam end 902 pushes upward on the end 402 of the lever 400. In one motion, the tip 404 of the pivot lever 400 rotates downwardly on pin 202 such that the tip 404 becomes disengaged from the grooves 309 of the door lock rod 300. The coil spring 302 can then resiliently urge the rod 300 upward by pushing on the rod bushing 306.

In some constructions for use in schools, a lock is installed on the classroom side of the door lock system. The lock allows the teacher to prevent students from engaging the system and potentially locking the teacher out of the room. In one construction, all locks in a school can be keyed alike thereby allowing use in any classroom. In the event of a situation requiring a lock down of the room, the teacher may use the key to unlock the door lock system and then depresses the locking rod 300 thereby engaging the system 100 and then following Established Security Protocol. In the event of an emergency exit by the rooms occupants, a normal depressing of the door handle either up or down disengages the lock bar 300 for immediate egress.

Figure 16:
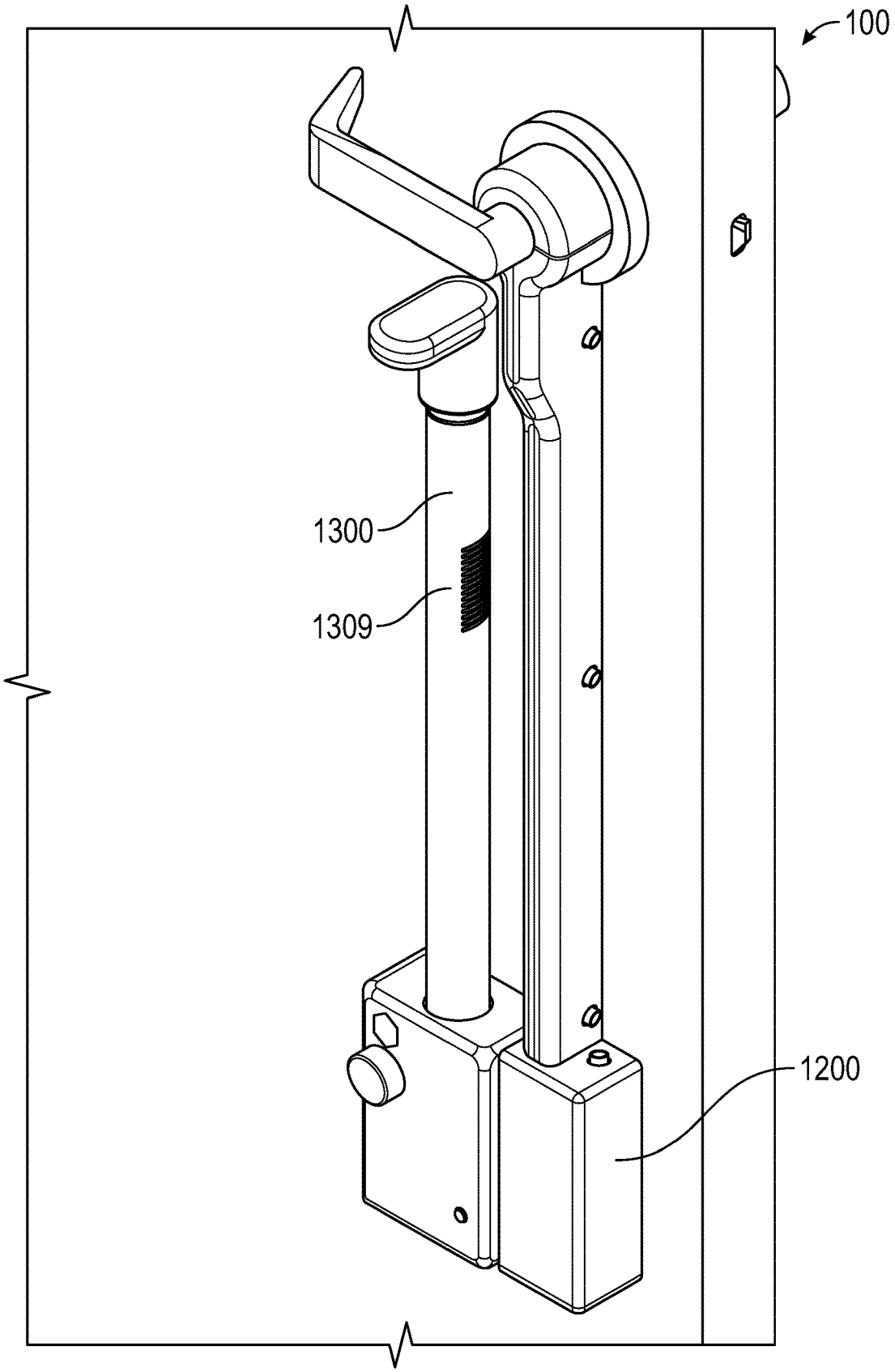
FIG. 16 illustrates a schematic diagram an alternative barrier locking system in which certain aspects of the present disclosure may be implemented.
Figure 17:
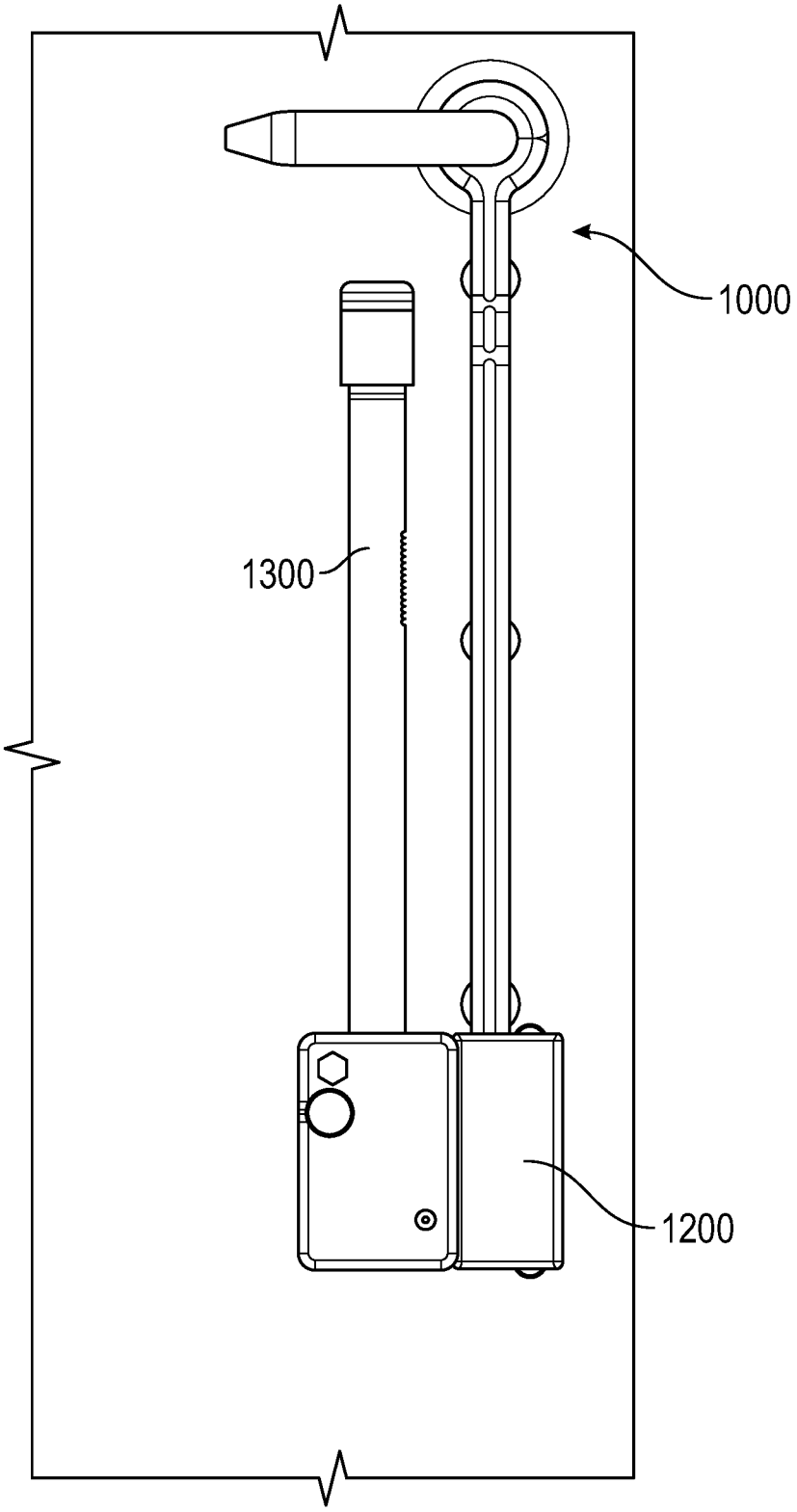
FIG. 17 illustrates a schematic diagram of a front elevation of the alternative barrier locking system in which certain aspects of the present disclosure may be implemented.
Figure 18:
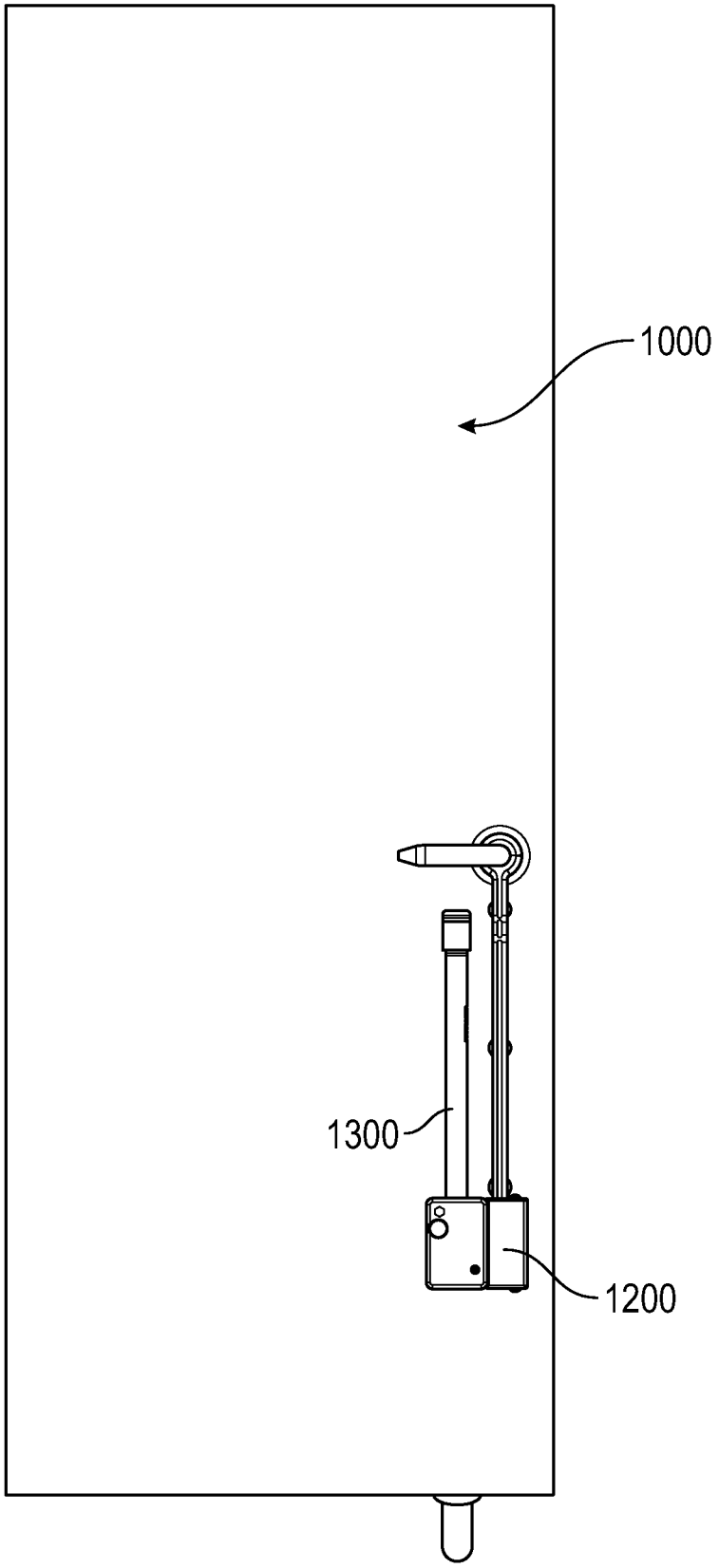
FIG. 18 illustrates a schematic diagram of the alternative barrier locking system on barrier, such as a door, in which certain aspects of the present disclosure may be implemented.

FIGS. 16-18 illustrates a schematic diagram an alternative barrier locking system 1000 in which certain aspects of the present disclosure may be implemented. The barrier lock bar 1300 has a cam key assembly installed to allow the barrier lock bar 1300 to be pulled up and rotated to insure the engaged position. The barrier lock bar 1300 is pulled up and turned to engaged position and reversed to return to down position flush with base plate resulting in a dormant position, the guide pin provides the barrier lock with limited movements within the casing 1200. The barrier lock bar 1300 has indented grooves vertical and lateral 1309 that determines the length and depth of movement up-and-down and the position at which the barrier lock bar 1300 stays in place once turned to the right.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A locking system for a door accessible safe zone for individuals or property inside the zone, comprising:

a vertically slidable lock rod movable with respect to a door of a door accessible safe zone, the lock rod having a plurality of grooves disposed longitudinally on an exterior surface thereof; wherein a top end of the lock rod includes a top member configured to receive a pushing force by a hand of human user, and a distal end of the lock rod being opposed to the top end, such that the distal end of the lock rod is engageable into a support structure responsive to said pushing force;

a pivot lever being rotatably mounted to a pin being disposed proximate to a distal tip of the pivot lever; wherein upon responsive to the locking rod downward movement from the pushing force, the distal tip becomes engageable with the grooves of the lock rod so as to prevent upward vertical movement of the lock rod, when the distal tip is lockingly engaged with the grooves of the lock rod thereby defining a locking state of the door accessible safe zone; wherein the distal tip of the pivot level has a rounded locking exterior surface configured to engage within the grooves of the lock rod;

a bushing disposed around the lock rod, and a coil spring disposed around the lock rod, and the coil spring being disposed underneath the bushing, the coil spring being compressed during the locking state; the coil spring being configured to urge the lock rod vertically by abutting engagement of the bushing and;

a wire member being connected to the pivot lever, and a handle of the door; the wire member being responsive to rotating movement of the handle for upwardly linearly movement of the wire member to rotate the pivot lever on the pin, such that the distal tip of the pivot lever rotates downwardly to disengage the pivot lever distal tip from the grooves of the lock rod for enabling the lock rod to slide vertically upward responsive to a resilient biasing force provided by said coil spring; and a releasable cam shaped member being engageable with a bottom surface of the pivot lever; the cam member being rotatable to pivot the pivot lever downwardly to disengage the distal tip from the grooves of the lock rod for enabling the lock rod to slide vertically upward responsive to the resilient biasing force provided by said coil spring.

2. The system according to claim 1, further comprising a button having a distal tip being engagable with the bottom surface of the pivot lever; the button being linear movable to rotate the pivot lever downwardly to disengage the tip from the grooves for enabling the lock rod to slide vertically upward responsive to a resilient biasing force provided by said coil spring of the lock rod.

3. The system according to claim 2, wherein the button further comprises a coil spring configured to urge the button away from the pivot lever.

4. The system according to claim 1, further comprising a control box having a control portion housing the pivot lever and a rod region for retaining the lock rod; an indent in the exterior surface of the lock rod, the indent being disposed away from the grooves of the lock rod, and a set screw for being disposed in the control box; wherein the set screw is configured to engage into the indent of the lock rod to prevent upward vertical movement of the lock rod when the distal tip of the pivot lever is disengaged from the grooves of the lock rod.

5. The system according to claim 1, wherein the lock rod is constructed of a plastic material.

6. The system according to claim 1, further comprising a control box having a control portion housing the pivot lever and a rod region for retaining the lock rod.

7. The system of claim 1, further comprising a spring-loaded cavity member for receiving the distal end of the lock rod in a support structure.

8. The system of claim 1, wherein the lock rod comprises a cross-sectional shape having opposing arcuate surfaces in which one of the arcuate surfaces includes the plurality of the grooves, the cross-section shape further includes two opposing channel portions disposed in between the opposing arcuate surfaces.

9. A locking system for a door accessible safe zone for individuals or property inside the zone, comprising:

a slidable lock rod movable with respect to a door of a door accessible safe zone, the lock rod having a plurality of grooves disposed longitudinally; wherein a top end of the lock rod includes a top cap member configured to receive a pushing force by a hand of human user, and a distal end of the lock rod being opposed to the top end, such that the distal end of the lock rod is engageable into a support structure responsive to said pushing force;

a pivot lever being rotatably mounted to a pin being disposed proximate to a tip of the pivot lever; wherein upon responsive to the locking rod downward movement from the pushing force, the tip becomes engaged within the grooves of the lock rod so as to prevent upward vertical movement of the lock rod, when the tip is lockingly engaged with the grooves of the lock rod thereby defining a locking state of the door accessible safe zone; wherein the tip of the pivot level has a rounded locking exterior surface configured to engage within the grooves of the lock rod;

a bushing disposed around the lock rod, and a coil spring disposed around the lock rod, and the coil spring being disposed underneath the bushing, the coil spring being compressed during the locking state; the coil spring being configured to urge the lock rod vertically by abutting engagement of the bushing by a resilient biasing force;

an elongated release member being connected to the pivot lever, and a handle of the door; the elongated release member being responsive to rotating movement of the handle for upwardly linearly movement of the elongated release member to rotate the pivot lever on the pin, such that the distal tip of the pivot lever rotates downwardly to disengage the pivot lever distal tip from the grooves of the lock rod for enabling the lock rod to slide vertically upward responsive to the resilient biasing force provided by said coil spring; and a teardrop shaped member engageable with a bottom surface of the pivot lever; the teardrop shaped member being rotatable to pivot the lever downwardly to disengage the tip from the grooves of the lock rod for enabling the lock rod to slide vertically upward responsive to the resilient biasing force provided by said coil spring of the lock rod.

10. The system according to claim 9, further comprising a releasable button having a distal end being engageable with the pivot lever; the releasable button being linear movable to pivot the lever downwardly to disengage the tip from the grooves for enabling the lock rod to slide vertically upward responsive to a resilient biasing force provided by said coil spring of the lock rod.

11. The system according to claim 10, wherein the releasable button further comprises a coil spring configured to urge the button away from the pivot lever.

12. The system according to claim 9, further comprising a control box having a control portion housing the pivot lever and a rod region for retaining the lock rod; an indent in the exterior surface of the lock rod, the indent being disposed away from the grooves of the lock rod, and a set screw for being disposed in the control box; wherein the set screw is configured to engage into the indent of the lock rod to prevent upward vertical movement of the lock rod when the distal tip of the pivot lever is disengaged from the grooves of the lock rod.

13. The system according to claim 9, further comprising a spring-loaded cavity member configured for receiving the distal end of the lock rod in the support structure.

14. The system according to claim 9, wherein the lock rod is constructed of a material selection of at least one of a plastic, metal, aluminum or steel.

15. The system according to claim 9, further comprising a control box having a control portion for housing the pivot lever and a rod region for retaining the lock rod.

16. The system according to claim 9, wherein the lock rod comprises a cross-sectional shape having opposing arcuate surfaces in which one of the arcuate surfaces includes the plurality of the grooves, the cross-section shape further includes two opposing channel portions disposed in between the opposing arcuate surfaces.

* * * * *